United States Patent [19]

Bonnefoy

[11] Patent Number: 4,821,533

[45] Date of Patent: Apr. 18, 1989

[54] METHOD OF SETTING PRECIOUS STONES, AS WELL AS JEWELRY MADE BY THIS METHOD

[75] Inventor: Alain Bonnefoy, Eaubonne, France

[73] Assignee: Cartier International B.V., Amsterdam, Netherlands

[21] Appl. No.: 144,157

[22] Filed: Jan. 15, 1988

[30] Foreign Application Priority Data

Jan. 19, 1987 [FR] France ..... 87 00513

[51] Int. Cl.[4] ..... A44C 5/00

[52] U.S. Cl. ..... 63/3; 63/27; 63/28; 63/15; 29/10

[58] Field of Search ..... 63/15, 3, 26, 27, 28, 63/30; 29/10, 160.6

[56] References Cited

U.S. PATENT DOCUMENTS

| | | | |
|---|---|---|---|
| 1,032,025 | 7/1912 | Robbins | 63/28 |
| 2,265,956 | 12/1941 | Schenck | 63/27 |
| 3,974,662 | 8/1976 | Avédissian | 29/160.6 X |

FOREIGN PATENT DOCUMENTS

| | | |
|---|---|---|
| 2384468 | 10/1978 | France . |
| 2428990 | 1/1980 | France . |
| 2488496 | 2/1982 | France . |
| 452254 | 5/1968 | Switzerland . |
| 2058546 | 4/1981 | United Kingdom . |

*Primary Examiner*—Kenneth J. Dorner
*Assistant Examiner*—Laurie K. Cranmer
*Attorney, Agent, or Firm*—Cushman, Darby & Cushman

[57] ABSTRACT

A method of setting precious stones in jewelry includes providing a metal support element of U-shaped cross section with two lateral bands separated by a central band and defining between them a channel, providing holes in the lateral bands and placing the stones into the channel and securing the stones in place in the channel with a wire passed through the holes from one band to the other across the channel.

8 Claims, 1 Drawing Sheet

METHOD OF SETTING PRECIOUS STONES, AS WELL AS JEWELRY MADE BY THIS METHOD

FIELD OF THE INVENTION

The present invention relates to a method of setting precious stones in order to obtain jewelry, in particular rings or bracelets, set with diamonds or other cut precious stones.

BACKGROUND OF THE INVENTION

Since the earliest times, jewelers have made jewelry by mounting precious cut stones of all kinds in gold, platinum and silver. Nowadays, diamonds and precious stones are most often held in a metal support with prongs or mounts.

If stones that are set directly into the metal are disregarded, then this kind of mounting is at present used virtually universally, not only for diamonds, whatever their cut (brilliant, rose, marquise, cabochon), but for other precious stones as well.

This has the disadvantage of requiring very long and painstaking and hence tedious work, and of being unadaptable to jewelry not having a relatively classical style.

SUMMARY OF THE INVENTION

Accordingly, it is the object of the present invention to propose a novel method for setting precious stones that is simpler and faster to use than the classical mounting method using prongs, and which, parallel to the finished jewels, lends a "stripped-down" appearance that agrees perfectly with current tastes.

According to the invention, this method is characterized in that a metal support element having a U-shaped cross section is made, including two lateral bands separated by a central band and between them defining a channel corresponding in size to that of the stones to be set; holes separated by a distance corresponding to the dimensions of the stones are pierced through each of the lateral bands; the stones are put into place side by side in the channel; and a metal wire is passed through the holes of the lateral bands of the support element, proceeding from one segment to the other on both sides of the channel in such a manner as to hold the stones therein.

This manner of setting according to the invention is generally rather like a stitched seam. In effect, the stones are sewn in some manner into the support element. It is equally possible to set one stone at a time by soldering a plurality of individual wires, similar to pins, so that the appearance of the the seam as seen from the side can be modified or concealed, and it will be understood that the setting according to the invention can alternate with a conventional setting if desired.

This method is more particularly adapted to fabricating wedding rings that are set with diamonds or faceted cut precious stones, in particular brilliants or cabochons, over either the entire periphery of the rings, or over only a portion thereof.

However, it may also be used for making totally different jewelry such as pins or earrings, or necklaces or bracelets. In necklaces and bracelets, the support element should not be rigid but is instead articulated, in particular by means of chain links. Naturally this method may also be employed in creating costume jewelry.

In all cases, the lateral bands prevent the lateral displacement of the stones, while the seam retains them at the front.

In another feature of the invention, the two lateral bands are parallel, and the holes in these two bands correspond two by two on a perpendicular or diagonal common to them.

This configuration is used most frequently in accordance with the invention; it can also be provided, in the case of earrings, pendants or costume jewelry, that there be two bands that curve outward at an angle and are separated by stones of increasing size; in this case, the holes of the bands must correspond two by two on axes of the same direction, in particular parallel to the plane that bisects the two bands.

In accordance with the invention, the metal wire thus describes a more or less deformed "sinusoid" around the stones and at the front of the stones, in order to hold them in the channel. It is easy to imagine that in the manner of a conventional stitched seam, this wire projects from the outer faces of the lateral bands in the regions corresponding to the "stitches" at the intervals located between the holes.

In another feature of the invention, grooves are dug out between the holes of the lateral bands of the support element, so that every other interval between the holes is underscored with a groove.

This characteristic makes it possible to "embed" the metal wire so that it will not project from the outer face of the bands, which increases the strength of the piece of jewelry and decreases wear, while improving its appearance.

It will be understood that in order for the grooves to correspond to the aforementioned "stitches" and hence to the portions of the metal wire that project on the outer face of the lateral bands, the grooves must be offset in alternation on the two lateral bands of the support element.

In accordance with another feature of the invention, the central band of the support element includes perforations provided at the level of the rear portion of the stones, in particular their bottom ends, to expose them to light.

This feature enhances the beauty of the diamonds or brilliant-cut precious stones.

It will be understood that the method according to the invention can be used for making costume jewelry; however, it proves to be particularly well suited to making pieces of precious jewelry in which the support element and the wire are of a metal selected from the group comprising gold, silver and platinum, while the precious stones are diamonds, emeralds, rubies or sapphires.

The cross section of the wire may be of any arbitrary kind without departing from the scope of the invention; most frequently, it is circular.

The invention also relates to a piece of jewelry made by performing the aforementioned method.

This jewelry is characterized in that it comprises a metal support element, in particular of a precious metal, having a cross section in the form of a U, including two lateral bands separated by a central band and between them defining a channel into which precious stones disposed side by side are placed, the stones being held laterally by the lateral bands and at the front by a metal wire, particularly a wire made of a precious metal, inserted into holes pierced into the lateral bands passing from one side to the other of the channel.

This jewelry may be of any kind without departing from the scope of the invention and may comprise earrings, pendants, bracelets, necklaces, and so forth.

Nevertheless, very often this jewelry comprises a ring or wedding band surrounded totally or partially with small diamonds or precious stones.

Another configuration of this piece of jewelry corresponds to a rigid bracelet, surrounded totally or in part by brilliants or precious stones. In this case, it must be provided with a swivel joint, on the one hand, and clasp elements, on the other, so that it can be put on.

Moreover, once it is inserted, the metal wire is soldered either to itself (in the case of jewelry in the form of a closed ring) or to the support element in order to effect the final retention of the jewelry.

The characteristics of the method and of the jewelry that are the subject of the invention will now be described in further detail with reference to the accompanying drawings.

DESCRIPTION OF THE PREFERRED EMBODIMENT

Figure 1:
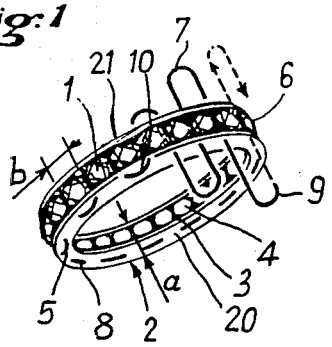
FIG. 1 shows a diamond wedding ring, in accordance with the invention.

In FIG. 1, the brilliant-cut precious stones 1 with which the wedding band according to the invention is set are mounted on an annular support element 2 having a U-shaped cross section including two annular lateral bands 20 and 21 separated by a central annular band 3 including perforations 4 provided at the level of the bottom end of the stones 1 in order to expose them to light, so that they can sparkle with all their brilliance.

The width a of the central band 3 corresponds to that of the stones 1. This band 3 cooperates with the lateral bands 20 and 21 of the support element 2 in order to define a channel 6 into which the stones 1 are put in place side by side.

The stones 1 are then retained laterally by the bands 20 and 21. To enable their retention at the front, the bands 20 and 21 are pierced with holes 5 that correspond from one band to the other and are separated by a distance b corresponding to the dimensions of the brilliant-cut stones 1.

These holes 5 are used for the placement on both sides of the channel 6 of a metal wire 7, which describes a deformed "sinusoid" that projects on the outer face of the bands 20 and 21 via stitches 8 that are similar to those of a seam.

FIG. 1 shows the wire 7 in the course of being inserted. In a manner not shown in this figure, when the wire has been inserted over the entire periphery of the annular support element 2, it is soldered to itself at its ends 9 in order to assure the integrity of the entire ring. It is easy to imagine that the brilliant-cut stones 1 are then held perfectly satisfactorily inside the channel 6.

Moreover, grooves 10 are provided on the outer face of the lateral bands 20 and 21 in the vicinity of the stitches 8, to prevent the wire 7 from projecting to the outside and hence to improve the esthetic appearance of the jewelry. These grooves 10 are naturally offset from one lateral band 20, 21 to the other in order in each case to correspond to the apex of the sinusoid described by the wire 7.

It should be noted that the ring shown in the drawing may either be made from a precious metal or may equally well be a piece of costume jewelry.

Figure 2:
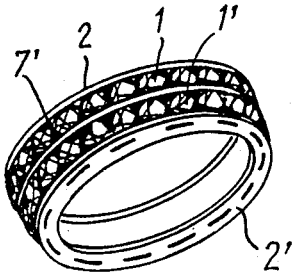
FIG. 2 is a perspective view similar to FIG. 1 but showing a wedding ring that includes two rows of stones, in accordance with the invention.

As shown in FIG. 2, the invention is also applicable to a wedding band including two rows of stones 1 and 1'. In this case, two identical support elements 2 and 2' must be provided, which are connected in any arbitrary manner and are in particular soldered to one another.

In the case shown in the drawing, the wire 7' is mounted on the stones 1, 1' placed diagonally with respect to one another.

By the same pattern, it is naturally possible to provide a ring that includes a greater number of rows of stones.

Figure 3:
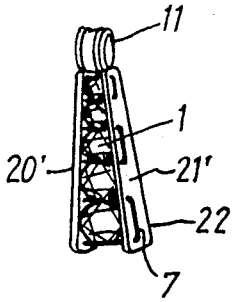
FIG. 3 shows a pendant in accordance with the invention.

As shown in FIG. 3, in the case of a pendant, prior to its being hung on a chain, not shown, by means of a slip ring 11, it is provided with a support element 22, the lateral bands 20' and 21' of which are not parallel but instead widen angularly toward the base. In this case, it is naturally necessary to provide stones 1 of increasing size.

Figure 4:
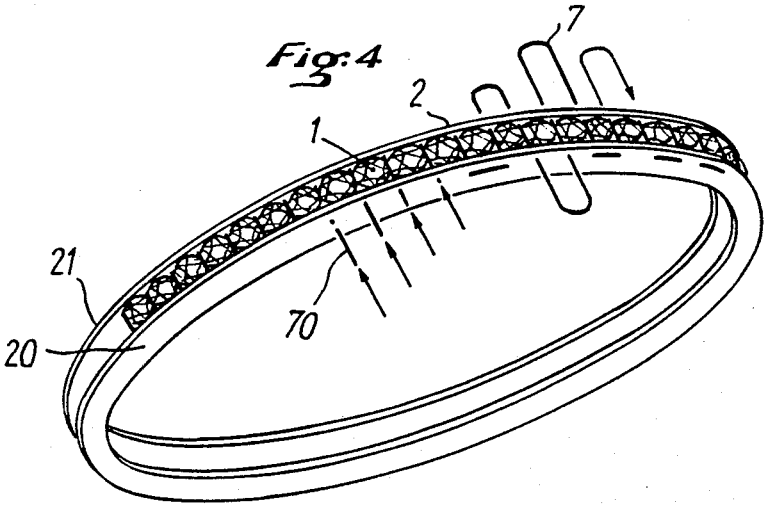
FIG. 4 shows a bracelet in accordance with the invention.

In FIG. 4, the stones 1 of a bracelet are retained toward the front either with a single "sewn" wire 7 or with separate wires 70 forming pins that are individually soldered to the lateral segments 20 and 21 of the support element 2 having a Ushaped cross section.

It will be understood that, as has already been noted, the jewelry shown in the drawings must be considered solely as an example, and that the invention is applicable to jewelry having a totally different configuration.

What is claimed is:

1. A method for setting precious stones for making pieces of jewelry, in particular rings or bracelets of the type set with precious stones, comprising the steps of providing a metal support element having a U-shaped cross section and including two lateral bands separated by a central band with the bands defining a channel corresponding in width (a) to the width of the stones to be set; providing in each lateral band holes separated on each band by a distance (b) corresponding to the dimensions of the stones; placing the stones side by side in the channel; passing a metal wire in the holes in the lateral bands proceeding from one band to the other across the channel to hold the stones therein.

2. The method as claimed in claim 1 wherein said two lateral bands extend substantially parallel to one another and each said hole of one band is located in alignment with a corresponding hole in the other band.

3. A method as defined by one of claims 1 or 2, including the step of forming perforations in the central band of the support element to expose the stones to light.

4. A method as defined by one of the claims 1 or 2, characterized in that the support element and the wire are made of a metal selected from the group comprising gold, silver and platinum.

5. A method as defined by one of the claims 1 or 2, characterized in that the cross section of the wire is circular.

6. The method as claimed in claims 1 or 2 further including the step of forming grooves in said lateral bands between every other interval between the holes.

7. The method as claimed in claim 6 including the step of offsetting alternate ones of said grooves in said lateral bands.

8. A piece of jewelry comprising a metal support element having a cross-section in the form of U including two lateral bands separated by a central band, said lateral bands having holes formed therein, with said lateral bands and said central band defining a channel into which precious stones disposed side-by-side are placed, means for holding the stones laterally between said lateral bands comprising a metal wire inserted through said holes in said lateral bands with said wire passing through a hole in one lateral band through an adjacent hole in the other lateral band, alternately.

* * * * *